US006557706B2

(12) United States Patent
Bowers et al.

(10) Patent No.: US 6,557,706 B2
(45) Date of Patent: May 6, 2003

(54) BOTTOMLESS BATTERY CONTAINER

(75) Inventors: Douglas B. Bowers, Lititz, PA (US); Howard R. Coulter, Landisville, PA (US)

(73) Assignee: Interstate Container LLC, Reading, PA (US)

( * ) Notice: Subject to any disclaimer, the term of this patent is extended or adjusted under 35 U.S.C. 154(b) by 0 days.

(21) Appl. No.: 09/842,398

(22) Filed: Apr. 26, 2001

(65) Prior Publication Data

US 2002/0157986 A1 Oct. 31, 2002

(51) Int. Cl.[7] ..... B65D 81/02
(52) U.S. Cl. ..... 206/703; 206/592
(58) Field of Search ..... 206/703, 583, 206/446, 591, 592, 320

(56) References Cited

U.S. PATENT DOCUMENTS

| | | | | |
|---|---|---|---|---|
| 2,578,107 A | | 12/1951 | Thacker et al. | |
| 2,779,527 A | | 1/1957 | Fallert | |
| 3,056,536 A | | 10/1962 | Smith et al. | |
| 3,146,132 A | | 8/1964 | Nathan | |
| 3,767,038 A | * | 10/1973 | Channing et al. | 206/459.5 |
| 4,323,156 A | | 4/1982 | Grueneberg | |
| 4,339,032 A | * | 7/1982 | Wood | 206/158 |
| 5,544,755 A | * | 8/1996 | Paumen et al. | 206/485 |
| 5,775,503 A | * | 7/1998 | LeBras | 206/158 |
| 5,927,502 A | * | 7/1999 | Hunter | 206/194 |

* cited by examiner

*Primary Examiner*—Shian Luong
(74) *Attorney, Agent, or Firm*—John S. Hale; Gipple & Hale

(57) ABSTRACT

A bottomless battery container for transporting and storing batteries is constructed of side panels and end panels. Each side panel is provided with an integral cushion assembly defining cutouts for battery terminals and battery filling caps. Each cushion assembly has a plurality of parallel score lines allowing it to be folded into a rectangular form having a top section, and end section and a bottom section with cutouts on the bottom section and an end section being adapted to receive battery filler caps and battery terminal posts. A glue panel extending from the bottom section is fastened to the interior upper portion of the side panel. When the container is assembled the outer walls of the end section of each cushion assembly abut each other with the dimension of the width of the cushion assembly being about one half the width of each end panel.

19 Claims, 2 Drawing Sheets

BOTTOMLESS BATTERY CONTAINER

CROSS-REFERENCE TO RELATED APPLICATIONS

There are no other applications related to the present application.

TECHNICAL FIELD OF THE INVENTION

The present invention generally relates to packaging and more specifically to improvements in shipping containers for batteries. The battery container is configured to be used to store batteries in a specifically designed container allowing the same to be easily stored and transported and for otherwise maintaining the battery in a clean and undamaged condition until the battery is to be used. Thus this invention relates to improvements in a battery carton, and more particularly to cartons used as a protective cover for protecting the filler caps and terminals of automotive type batteries during shipping.

BACKGROUND OF THE PRIOR ART

Automobile and other batteries are constructed so that they have projections extending upwardly beyond the upper surface of the battery. These projections are in the form of filler caps, terminal straps and terminal posts which extend higher than the filler caps. The terminal posts are made of soft material such as lead and are in danger of being easily broken or bent prior to reaching the consumer. This damage occurs in the most part in loading the batteries for shipment as they are placed vertically one on top of the other in a stack so as to build up a considerable weight upon the lowermost battery and when palletized, shift during transportation. Similar stacking occurs when the batteries are stored on dealers' shelves or for warehousing in order to make most efficient use of available space. In view of this stacking the container must provide protection to the fragile terminals and filler caps against distortion, breakage or damage by directing the weight of the batteries on the rigid container of the battery. The weight on the lowest battery in a stack of superimposed batteries may amount to several hundred pounds or more.

The filler caps of the batteries which are commonly made of plastic, and the lead terminals must be protected from the weight of other batteries resting upon them and moving against them. For this purpose, pasteboard protective cartons have long been used. These cartons ordinarily have one or more flanges depending from the carton top resting upon the top of the battery between the filler caps, the flanges providing support for the next battery above.

Previous protector cartons have also used a filler made of foam to protect the battery stems or have used corrugated paperboard containers which have multiple flaps folded over to provide protection to the battery.

One patent to Thacker et al. U.S. Pat. No. 2,578,107 issued Dec. 11, 1951 discloses a shipping package for a storage battery constructed of corrugated carton material. Each of the side panels has an individual assembly foldably mounted on the top section of each side wall to form a cushion of double thickness. The assembly blank is provided with a cut-out portion which receives the upstanding terminals of a storage battery. The cushion acts as a shock for the package and allows stacking. One of the problems with this design is that the reentrantly folded flap sections which form the cushion must be perforated to enable forming a notch in the sides of the cushion for allowing the cushion to clear a filler cap or terminal post when the container is placed on a battery. Furthermore the score lines in the flap for forming the beam are likely to have a tendency to unfold and the cushions do not bear exclusively on the top of the battery case but could bear on the lead straps that connect the battery cells. Another patent to Fallert, U.S. No. 2,779,527 issued Jan. 29, 1957 disclosed a one piece corrugated cardboard box for shipping batteries in which each side of the box has an upper flap with associated mating tabs and cut outs which are folded over the top of the battery to form a double layer of cardboard protection. The reentrantly bent and interfaced flap sections carry all of the load. The reentrantly folded flaps have a tendency to unfold and can easily do so until another pair of cover flaps are locked with them.

The Nathan patent, U.S. No. 3,146,132 issued Aug. 25, 1962 discloses a plastic battery climatizer cover having a folding top which fastens on snap members located on the end walls and side walls of the cover box. A slide fastener is provided in the top of the lid for access to the battery. The lid also defines holes in the form of large eyelets through which the terminal posts of the battery can extend.

The Smith et al. patent Number 3,056,536 issued Oct. 2, 1962 discloses a bottomless battery carton made form a single blank of material having end flaps which extend along the upper edge of the end walls with the top of the carton folding over to provide a spaced portion on its upper surface. In this patent there are cover flaps that are bent horizontally from opposite vertical side walls to fit tightly between the reentrantly bent flap sections that define the shoulders. Thus the load is concentrated on narrow shoulders with the absence of any additional support for the top of the container for distributing some of the load over areas of the battery case other than its edges. The Grueneberg U.S. Pat. No. 4,323,156 issued Apr. 6, 1982 discloses another open bottomed storage battery container constructed of paperboard material for protecting components projecting from the top of the battery case. The container has four walls and a flap extending from a horizontal score line on each wall. Two opposed flaps have multiple angular score lines to enable folding them into tapered beams that rest on the top of the battery case. The other two opposed flaps serve as container covers. The flaps that serve as container covers have angular score lines defining cover and tongue sections. The tongue sections interface at an angle when the covers are closed and the ends rest on top of the battery case to provide support to that provided by the beams.

The present invention contemplates a battery carton which is formed with shoulders adapted to be supported on the upper edges of the hard casing walls only, never coming in contact with the soft middle portion. This battery container has been produced in a manufacturing environment and has been tested for strength and proved to be very suitable for the battery business.

Previous attempts to provide such a battery carton have resulted in devices which either did not effectively perform the desired function due to the shoulders moving inwardly from the carton walls and scaring or bending the soft terminal post and breaking the filler caps, or, where a spreading means has been employed, the pattern layout was too wasteful of material.

The inventive box itself is designed to form a protection for the battery caps and terminals. The box is easily erected and can save not only extra material but also time because the employee does not need to place a foam piece over the terminals and worry about placement.

Accordingly, a container has been developed to handle batteries which resolves these problems.

SUMMARY OF THE INVENTION

The present invention is a bottomless battery container for storing and transporting storage batteries comprising: side panels with connected cushion assemblies, each cushion assembly defining score lines between a top section, an end section and a bottom section. The cushion assembly defines shaped cutouts for receiving battery terminals and battery filling caps located at least in part on the bottom section which includes a fastening panel which is secured to an interior surface of its respective side panel.

It is, therefore, an object of the present invention to provide a protective carton for batteries in which the weight of the carton, and of objects supported thereon, will bear upon the carton walls and not upon the battery itself.

It is another object of the present invention to provide a storage battery container that affords maximum protection against the force of a stack of batteries being transmitted to any terminal post, connecting strap, filler cap or any other projecting element from the case of the battery.

It is also our object of the invention is to provide a battery shipping cover which may be automatically snap locked into an open position without the use of staples, glue or other fasteners providing a clearance above the battery cable terminals and filler caps.

Still another object of the invention is to provide an economical one-piece battery container for shipping and storing electric batteries which may be knocked down in a flattened condition for shipment and rapidly assembled with out the use of staples, glue or other fasteners.

Another object of the present invention is to provide a battery carton in which the usual side flaps are folded in a novel manner to provide a supporting shoulder spaced from the top of the carton.

A further object of the present invention is the provision of a battery carton of the character described which may be formed from a single rectangular blank without waste of the corrugated board material.

It is a further object to provide a battery carton of the character described in which a spreading action is exerted along substantially the entire length of the supporting shoulders, and in which the carton may be stapled together with conventional equipment and in a conventional manner.

Further objects and advantages of the invention will be apparent as the specification progresses, and the new and useful features of our battery carton will be fully defined in the claims attached hereto.

In the accompanying drawings, there is shown illustrative embodiments of the invention from which these and other objectives, novel features and advantages will be readily apparent.

DETAILED DESCRIPTION OF THE INVENTION

The preferred embodiment and best mode of the battery container invention is shown in FIGS. 1–4. The component material used for the battery container 10 is made from a corrugated cardboard which may optionally be provided with a waterproof coating.

Figure 1:
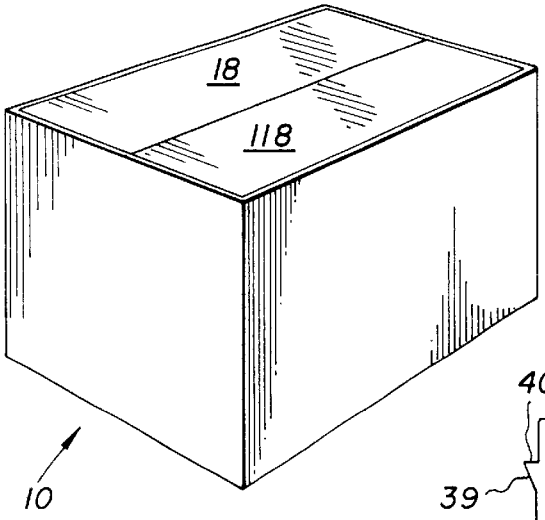
FIG. 1 is a perspective view of the battery container.
Figure 4:
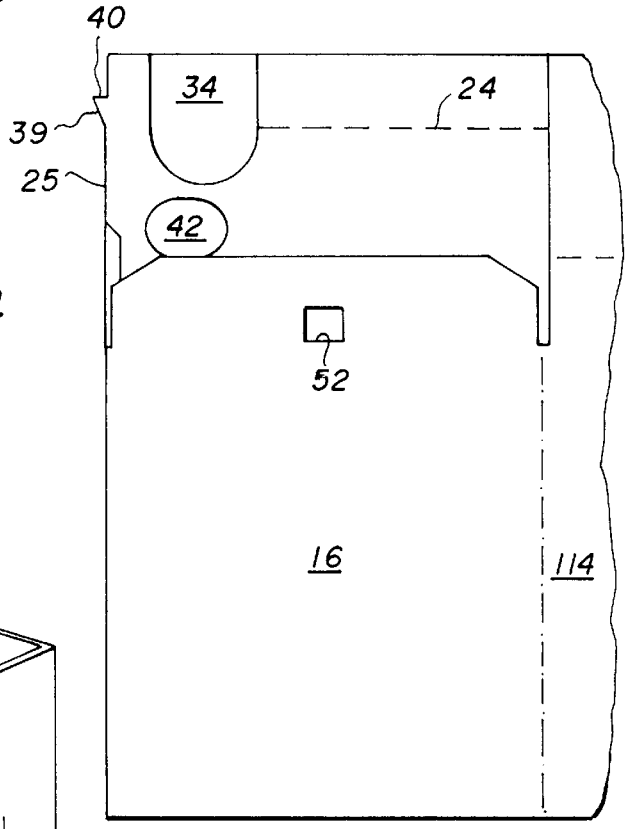
FIG. 4 is a partial front view of the end panel and side panel of the assembled container blank of FIG. 3.
Figure 2:
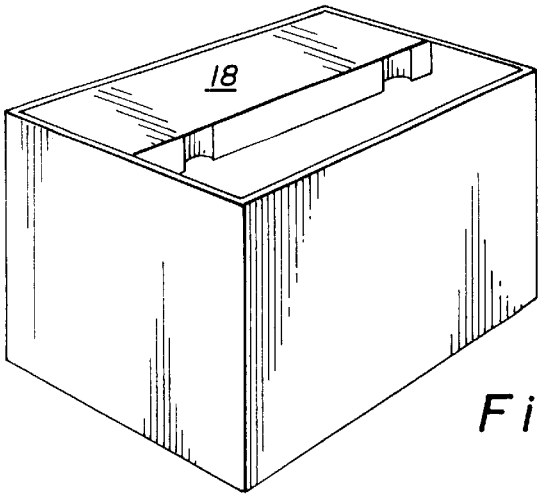
FIG. 2 is a perspective view of the battery container shown in FIG. 1 with one cushion assembly removed.
Figure 3:
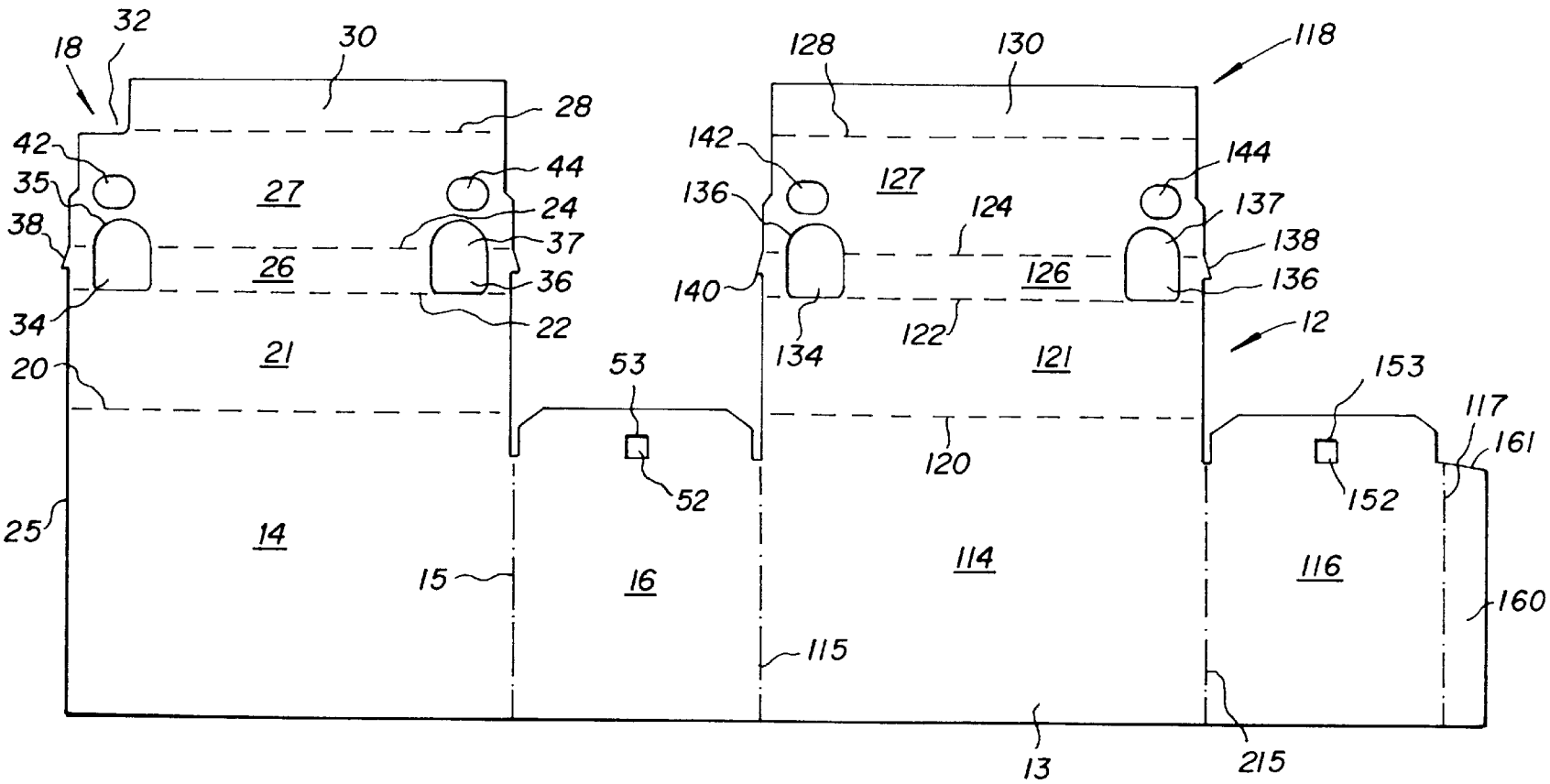
FIG. 3 is a plan view of the unfolded container blank for the battery container.

The battery container 10 as shown in FIGS. 1–4 is bottomless and is constructed from a single blank 12 with front surface 13 of corrugated paperboard as is most clearly shown in FIG. 3. If desired, one side of the corrugated paperboard blank may be coated with a water resistant layer or chemical treatment. A wide variety of resins such as recorcinol formaldehyde resins, urea formaldehyde resins and ketone aldehyde resins, e.g. acetone formaldehyde resins can be used for the waterproofing. The package blank 12 with front surface 13 as shown in FIG. 3 has a side panel 14 integrally formed with end panel 16 separated by a score line 15 allowing folding of the same into a side and end of the battery container 10. A first top cushion assembly 18 is integrally formed with side panel 14 and is separated from the same by a ¾×⅜ inch perforated score line 20. The first top cushion assembly 18 when folded has a width substantially equal to ½ the width of end panel 16 and is provided with two parallel score lines 22 and 24 which form an end section 26 when the assembly is folded along the score lines. The end section 26 defined by score lines 22 and 24 is positioned perpendicular to the top section 21 of the cushion assembly when it is folded over score line 20. A fourth score line 28 separates the bottom section 27 of the cushion assembly from the glue section 30. The glue section 30 is formed with an indent cut out 32 inset about 1¾ inches from the proximal edge surface of the glue section 30. The end section 26 defines two spaced cutouts 34 and 36 which have a rounded portion 35 and 37 respectively which extend over as cut outs into bottom section 27. The spaced cutouts 34 and 36 are configured to fit over the filler caps of a battery when the container 10 is assembled and placed over a battery. The outer edge of end section 26 defines an angled projection 38 which is adapted to fit into square cutout 52 cut in the upper middle surface of end panel 16 to provide a locking mechanism for the cushion assembly 18. The angled projection 38 has an angled outer surface 39 ending in a perpendicular step 40 which leads into edge 25 of the cushion assembly 18. Two rounded cutouts 42 and 44 are cut in bottom section 27 adjacent the rounded portions 35 and 37 of the spaced cutouts 34 and 36 for insertion over the terminal posts. The end panel 16 defines a throughgoing square aperture 52 cut therein which serves as a handle for the battery container and is defined and separated from the side panels 14 and 114 by score lines 15 and 115.

A second side panel 114 is integrally formed with the end panel 16 and end panel 116 with respective score lines 115 and 215 allowing folding of the same into a side and end panel. A second top cushion assembly 118 is integrally formed with side panel 114 and is separated from the same by a ¾×⅜ inch perforated score line 120. The top cushion assembly 118 is provided with two parallel score lines 122 and 124 which form a top section 121 and an end section 126 when the score lines are folded. The section defined by score lines 120 and 122 forms the top section 121 of the cushion assembly 118. A fourth score line 128 separates a rectangularly shaped glue section 130 from the bottom section 127 of the cushion assembly. The end section 126 defines two spaced cutouts 134 and 136 which have a rounded portion 135 and 137 respectively which extend over into bottom section 127. The spaced cutouts 134 and 136 are configured to fit over the filler caps of a battery when the container is assembled and placed over a battery. The outer edges of cushion assembly 118 defines a angled projection 138 which is adapted to fit into a notches 52 and 152 cut on the sides of end panels 16 and 116 to provide a locking mechanism for the cushion assembly 118. Two rounded cutouts 142 and 144 are cut in bottom section 127 adjacent the rounded portions 135 and 137 of the spaced cutouts 134 and 136. The end panel 116 defines a throughgoing square aperture 152 cut therein which serves as a handle for the battery container and is provided with score line 215 which forms the fold line between it and side panel 114 while score line 117 forms the fold line between it and glue panel 160.

In assembly of the bottomless battery container 10, glue or a suitable adhesive is applied on the rear surface of glue panels 30 and 130 and the respective cushion assemblies are folded over perforated score lines 22 and 122 and 24 and 124 with perforated score lines 28 and 128 being positioned at the base of notches 50 and 150 respectively, and glue panels 30 and 130 engaging the upper surfaces of side panels 14 and 114 and being secured thereto. End panel 116 is folded along score line 117 and the front surface 13 of the glue panel 160 is covered with glue or adhesive and is attached to the rear surface of side panel 14 with score line 117 being parallel to and adjacent the leading edge 25. The angled edge 161 of glue panel 160 fits with cutout notch 32 of glue panel 30.

After assembly, when the cushion assembly 18/118 is forced inward into the carton chamber, it rotates along perforated score lines 20/120 and 22/122 until locking notch 38/138 passes via inclined surface 39/139 into cut out 52/152 and end member 16/116 with the vertical step 40/140 engages the upper surface 53/153 of the square cutout 52/152. In this locked position the plane of top sections 21/121 is substantially parallel with the upper end surface formed by perforated lines 20 and 120 of end panels 16 and 116. The terminal cutouts 42/142 and 44/144 allow post terminal entry into the cushion chamber and the filler cutouts 34/134 and 36/136 form a semicircular entry at the end surface of section 26/126 as can be seen in FIG. 2.

The principles, preferred embodiments and modes of operation of the present invention have been described in the foregoing specification. However, the invention should not be construed as limited to the particular embodiments which have been described above. Instead, the embodiments described here should be regarded as illustrative rather than restrictive. Variations and changes may be made by others without departing from the scope of the present inventions defined by the following claims.

What is claimed is:

1. A bottomless battery container for storing and transporting storage batteries comprising:

side panels with connected end panels, each side panel being connected with an integral cushion assembly, each cushion assembly defining score lines between a top section, an end section and a bottom section;

each said cushion assembly defining cutouts for receiving battery terminals and battery filling caps located at least in part on said bottom section, said bottom section including a fastening panel which is secured to an interior surface of an adjacent side panel.

2. A container as claimed in claim 1 wherein all of said panels are waterproof.

3. A container as claimed in claim 2 wherein said panel waterproofing is a chemical treatment.

4. A container as claimed in claim 1 wherein said end panel has handle means.

5. A container as claimed in claim 4 wherein said handle means is a cutout aperture.

6. A container as claimed in claim 1 wherein one of said cushion assembly sections is provided with an adhesive allowing it to be fastened to an interior surface of said side panel.

7. A container as claimed in claim 1 wherein said end panels are notched along a portion of each end panel's exterior surface.

8. A bottomless battery container for storing and transporting storage batteries comprising:

side panels with connected end panels separated by score lines which permit folding of the panels with respect to each other, each side panel being connected with an integral cushion assembly, each cushion assembly defining score lines between a top section, an end section and a bottom section allowing each section to be folded along said score lines;

said cushion assembly defining cutouts for receiving battery filling caps located at least in part on said bottom section and said end section, said bottom section additionally defining cutouts for receiving battery terminal posts including a fastening panel which is secured to an interior surface of its respective side panel.

9. A bottomless battery container as claimed in claim 8 wherein said end panel has a handle in the form of a cutout aperture.

10. A bottomless battery container as claimed in claim 8 wherein said end sections are notched along a portion of its exterior surface edge to provide a locking mechanism with said end panels.

11. A bottomless battery container as claimed in claim 8 wherein said end panels had a top surface with inclined ends.

12. A bottomless battery container as claimed in claim 8 wherein said end panel has a handle in the form of a cutout aperture.

13. A bottomless battery container as claimed in claim 8 wherein said cushion assembly bottom section cutouts for receiving battery filling caps has a curved area which extends into said bottom section.

14. A bottomless battery container as claimed in claim 8 wherein said end sections are notched along a portion of its exterior surface edge to provide a locking mechanism with said end panels.

15. A bottomless battery container as claimed in claim 8 wherein said end panels have a top surface with inclined ends.

16. A bottomless battery container for storing and transporting storage batteries comprising:

side panels with connected end panels separated by score lines which permit folding of the panels with respect to each other, each side panel being connected with an integral cushion assembly, each cushion assembly defining score lines between a top section, an end section and a bottom section allowing each section to be folded along said score lines; each end section being provided with notch means formed along a portion of its exterior surface to allow locking with said end panels;

said cushion assembly defining cutouts for receiving battery filling caps located at least in part on said bottom section and said end section, said bottom section additionally defining cutouts for receiving battery terminal posts and including a fastening panel which is secured to an interior surface of a side panel connected to said integral cushion assembly.

17. A bottomless battery container as claimed in claim 16 wherein said notch means is an inclined surface with an end wall perpendicular to an outer edge of said end section wall.

18. A bottomless battery container as claimed in claim 16 wherein said end panels have a top surface with angled ends.

19. A bottomless battery container as claimed in claim 16 wherein said end panels had a top surface with inclined ends and a recessed cutout adjacent a pot portion of each side panel.

* * * * *